350-360 SR
XR 4,047,810
TX350-360

United Stat[illegible]

Morgan

[11] 4,047,810

[15] Sept. 13, 1977

[54] DUAL MODE COPYING MACHINE

[75] Inventor: Paul F. Morgan, Penfield, N.Y.

[73] Assignee: Xerox Corporation, Stamford, Conn.

[21] Appl. No.: 620,979

[22] Filed: Oct. 9, 1975

[51] Int. Cl.[2] ..... G03G 15/00

[52] U.S. Cl. ..... 355/3 R; 355/9; 350/161 S

[58] Field of Search ..... 355/3 R, 9, 17, 32, 355/53, 71; 96/1.1, 1 PE; 350/162 R, 161 S

[56] References Cited

U.S. PATENT DOCUMENTS

| | | | |
|---|---|---|---|
| 2,598,732 | 6/1952 | Walkup | 355/17 |
| 3,158,430 | 11/1964 | McNaney | 350/161 |
| 3,795,514 | 3/1974 | Tvirblis et al. | 355/9 |
| 3,905,683 | 9/1975 | Roach et al. | 350/161 |
| 3,907,407 | 9/1975 | Vilkomerson et al. | 350/161 |
| 3,912,386 | 10/1975 | Gorog et al. | 350/161 |
| 3,936,173 | 2/1976 | Kidd et al. | 355/3 R |

*Primary Examiner*—Stephen J. Tomsky
*Attorney, Agent, or Firm*—J. J. Ralabate; C. A. Green; H. Fleischer

[57] ABSTRACT

An apparatus in which a latent image of an original document is recorded on a photosensitive member. A light image of the original document is projected through a normally non-deformed transparent member onto the photosensitive member. An operator actuatable control deforms the transparent member producing a plurality of spaced grooves therein. The light image transmitted through the grooved portion of the transparent member is phase shifted with respect to the light image transmitted through the non-grooved portion thereof. In this way, the operator may deform the transparent member producing a modulated light image, or permit the transparent member to remain in the non-deformed condition so as not to modulate the light image.

23 Claims, 5 Drawing Figures

FIG. 4
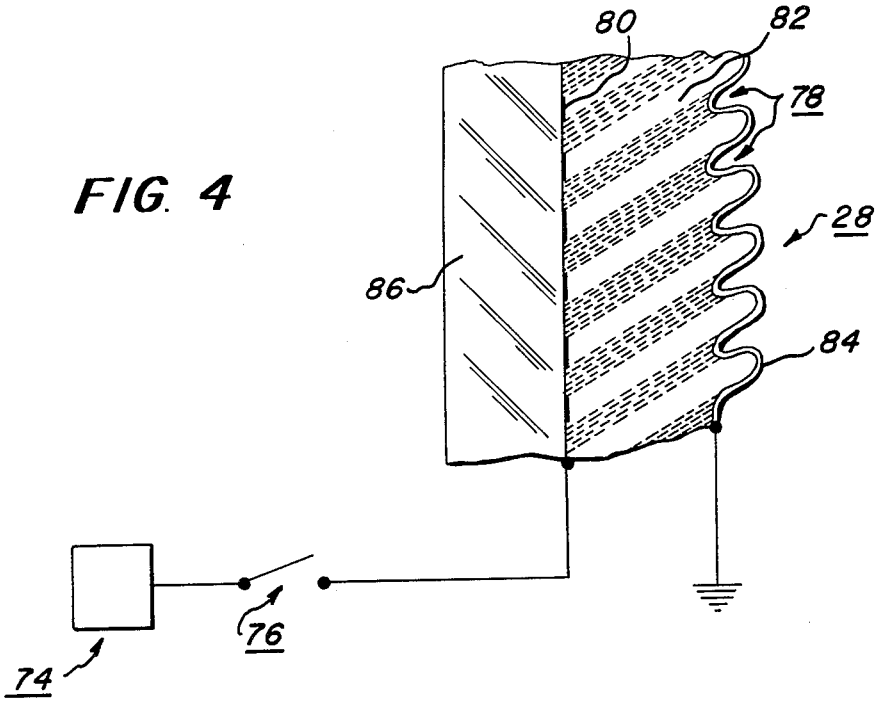
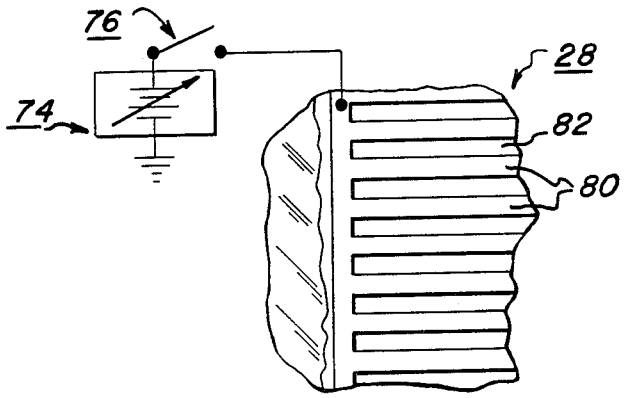
FIG. 5

DUAL MODE COPYING MACHINE

BACKGROUND OF THE INVENTION

This invention relates generally to an electrophotographic printing machine, and more particularly concerns an operator actuatable screen adapted to modulate the light image transmitted to the photosensitive member.

In a typical electrophotographic printing machine, a light image of an original document is projected onto the charged portion of the photoconductive member to record an electrostatic latent image thereon. The light image may be modulated by interposing a screen either spaced from or in contact with the photoconductive member. Screens of this type are known in the graphic arts, as well as in the electrophotographic printing art. The screen improves continuous tone reproductions by resolving the original image into a half-tone pattern of lines or dots. Generally, screens presently employed in an electrophotographic printing machine are spaced from the photoconductive member. The screen customarily includes absorbing rulings which depend on both absorption and diffraction of light to produce the desired light image modulation. Screens having absorbing rulings may be constructed by ruling straight grooves at the desired frequency, typically 24–80 lines/per centimeter, in glass or plastic. These grooves may be filled with an opaque material, and by varying the width of the rulings or modulating the absorption across a ruling, different screens may be produced.

More recently a ruled screen which only phase shifts and diffracts an incoming light wave has been developed. This type of screen is termed a phase screen and includes grooves cut in a nonlight absorbing solid transparent material having a depth on the order of the wave length of light. The grooves are un-filled (contain air). The screen periodcially phase shifts the incoming radiation. One significant advantage of the phase screen is that it does not absorb any light passing therethrough. Consequently, a shorter exposure time with a smaller light source is required when producing a half-tone pattern with a phase screen. A phase screen suitable for use in electrophotographic printing is described in copending application Ser. No. 556,387 filed in 1975.

Frequently, in electrophotographic printing, it is desirable to produce a functional copy rather than a pictorial copy of the original document. A functional copy is a copy of a document wherein subtle variations of tone or color are not present, such as in a graph, chart, lines, etc. Functional copying machines generally have great difficulty in forming tone gradations. A pictorial copying machine overcomes this defect by using a screen to produce tonal gradations. In the highlight regions, the halftone pattern may comprise narrow lines or small dots. The lines increase in width or the dots in size from the lighter through the intermediate shades until they merge together in the darker regions.

Numerous patents teach the concept of screening. Exemplary of these patents are U.S. Pat. Nos. 2,598,732; 3,535,036; 3,121,010; 3,493,381; 3,776,633; and 3,809,555. U.S. Pat. No. 3,861,784 teaches an electrically controllable diffraction grating. Of more particular interest is co-pending application Ser. No. 566,873, filed in 1975 which teaches the concept of moving a screen into and out of the optical light path. In this way, the electrophotographic printing machine may function both as a functional or pictorial copier. However, this type of a device requires movement of the screen. It would be extremely desirable to maintain the screen continuously in the optical light path with no movement associated therewith. An optical system employing a screen of this type is described in co-pending application Ser. No. 570,103 filed in 1975. As taught therein, a normally transparent liquid crystal panel is interposed into the optical light path. Energization of the liquid crystal panel forms an opaque screen pattern which modulates the light image passing therethrough.

The foregoing may be achieved by utilizing a selectively actuatable phase screen. Thus, in the functional copying mode the screen is merely a transparent member through which the light image would pass without any phase shift. Contrawise, in the pictorial mode of operation, the screen is actuated to phase shift the light image. In this way, the light image may remain unmodulated, or if appropriate be modulated.

It is well known in the art to employ deformable imaging systems, known generally as "Frost" imaging. The foregoing is described in greater detail in U.S. Pat. Nos. 3,196,012; 3,214,272; and 3,436,216. The techniques of Frost imaging may be applied to make selectable actuatable defraction gratings. For example, copending application Ser. No. 580,654 filed in 1975, now U.S. Pat. No. 4,011,009, teaches a variable reflection defraction grating selectively formed by a material deformable in the presence of a conductive grid having an electric field applied thereto, i.e., with a structure similar to the present invention, but employed in a different application.

Accordingly, it is the primary object of the present invention to improve electrophotographic printing machines by employing a selectively deformable operator actuatable screen.

BRIEF SUMMARY OF THE INVENTION

Briefly stated, and in accordance with the present invention, there is provided an apparatus for recording a latent image of an original document on a photosensitive member.

Pursuant to the features of the present invention, means are provided for projecting a light image of the original document through a deformable transparent member onto a photosensitive member. Means are provided for restorably deforming the transparent member to form a pattern of deformations therein. The light image passing through the deformed portion of the transparent member is phase shifted with respect to the light image passing through the non-deformed portion. In this manner, the light image transmitted to the photosensitive member is modulated. Finally, means are provided for selectably actuating the deforming means.

BRIEF DESCRIPTION OF THE DRAWINGS

Other objects and advantages of the present invention will become apparent upon reading the following detailed description and upon reference to the drawings, in which:

FIG. 4 is a fragmentary, sectional view of the screen member employed in the FIG. 2 exposure system; and FIG. 5 is a fragmentary, elevational view of the screen member used in the FIG. 2 exposure system.

While the present invention will be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
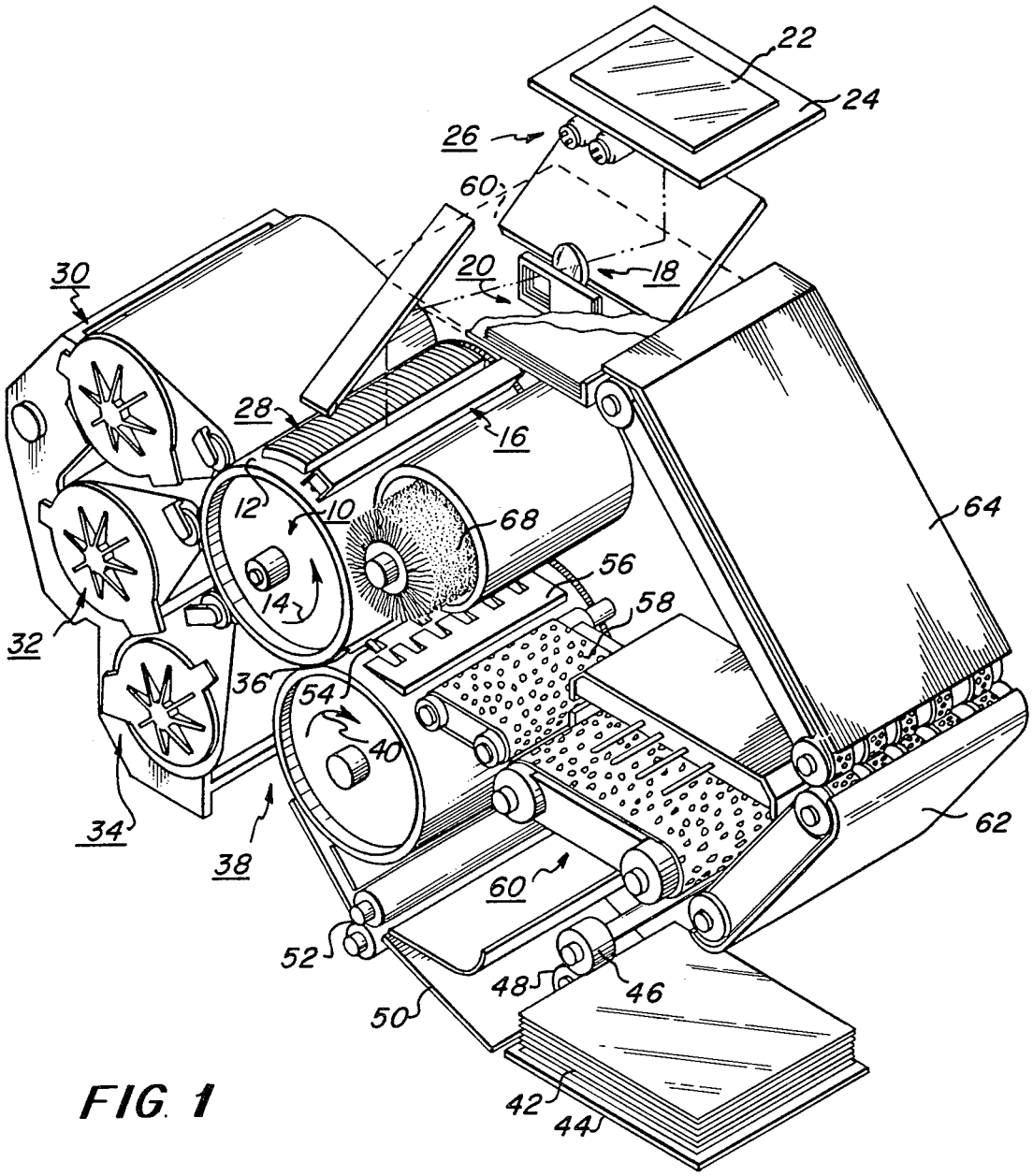
FIG. 1 is a schematic, perspective view of an electrophotographic printing machine incorporating the features of the present invention therein.

A general understanding of an electrophotographic printing machine incorporating the features of the present invention therein may be had by referring to FIG. 1. In all of the drawings, like reference numerals have been used throughout to designate identical elements. The electrophotographic printing machine is arranged to produce functional or pictorial copies from a colored original document. The original document may be in the form of single sheets, books, three dimensional objects, or colored slides. Preferably, the type of copy that is desired would depend upon the original document being reproduced. For example, bar charts, graphs, etc. would be reproduced as functional copies, whereas photographs would be reproduced in the pictorial mode.

As shown in FIG. 1, the electrophotographic printing machine includes a photoconductive member having a rotatable drum 10 with a photoconductive surface 12 entrained thereabout and secured thereto. Drum 10 is mounted on a shaft (not shown) and rotates in the direction of arrow 14. This moves photoconductive surface 12 sequentially through a series of processing stations. Preferably, photoconductive surface 12 is made from a suitable polychromatic selenium alloy such as is described in U.S. Pat. No. 3,655,377 issued to Scheck in 1972. A timing disc (not shown) is mounted on one end of the shaft of drum 10. This timing disc cooperates with a light source and photosensor to produce an electrical signal which is coupled to the machine logic. In this manner, as drum 10 rotates, the appropriate processing station is actuated.

For the purpose of the present disclosure, the various processing stations in the printing machine will be briefly described hereinafter.

As drum 10 rotates in the direction of arrow 14, it passes through charging station A. Charging station A includes a corona generating device, indicated generally by the reference numeral 16. Corona generating device 16 charges photoconductive surface 12 to a relatively high substantially uniform level. One type of suitable corona generating device is described in U.S. Pat. No. 3,875,407 issued to Hayne in 1975.

Thereafter, drum 10 rotates the charged portion of photoconductive surface 12 to exposure station B for projecting a color filtered light image of the original document thereon. Exposure station B includes a moving lens system, generally designated by the reference numeral 18, and a color filter mechanism, shown generally at 20. U.S. Pat. No. 3,062,108 issued in Mayo to 1952 describes a moving lens system suitable for use in electrophotographic printing. Similarly, a suitable color filter mechanism is described in U.S. Pat. No. 3,775,006 issued to Hartmant et al. in 1973. Original document 22 is disposed upon transparent viewing platen 24. Lamp assembly 26 is located beneath platen 24, and, in conjunction with lens system 18 and filter 20, move in a timed relationship with drum 10 to scan successive incremental areas of original document 22. A suitable type of lens is described in U.S. Pat. No. 3,592,531 issued to McCrobie in 1971. Transparent member 28 is interposed into the optical light path. The single color flowing light image of original document 22 is transmitted through normally transparent member 28. Application of a voltage to transparent member 28 results in the formation of a deformation pattern thereon. In this way, a plurality of spaced grooves are formed therein. The light image passing through the grooved portion of transparent member 28 is phase shifted relative to the light image passing through the non-grooved portion thereof. In its unenergized state, transparent member 28 remains undeformed and the light image is not phase shifted producing functional copies. Contrawise, when transparent member 28 is energized, grooves are formed therein resulting in a phase shift to produce a pictorial copy. The detailed structural arrangement of transparent member 28 will be discussed hereinafter in greater detail with reference to FIGS. 4 and 5. Preferably, transparent member 28 is an arcuate member. One skilled in the art will appreciate that while a curved transparent member will be described, a flat transparent member may be employed in lieu thereof.

In operation, the flowing light image passes through transparent member 28. If transparent member 28 is energized, a plurality of spaced grooves are formed therein which modulate the light image. Inasmuch as the light image has already been filtered, a modulated single color light image irradiates the charged portions of photoconductive surface 12. Successive color filters operate on the light rays passing through lens 18 to create successive differently colored modulated light images which record modulated single color electrostatic latent images on photoconductive surface 12. Transparent member 28 is energized only in the pictorial mode. When the printing machine is in the functional mode, transparent member is no longer de-energized, i.e., not deformed. More particularly, when transparent member 28 is de-energized, it is not electrically excited and grooves are not formed therein.

After the electrostatic latent image is recorded on photoconductive surface 12, drum 10 rotates to development station C. Three developer units, generally indicated by the reference numerals 30, 32 and 34 are positioned at development station C. A suitable development station employing a plurality of developer units (in this case three) is described in U.S. Pat. No. 3,854,449 issued to Davidson in 1974. Each of the developer units employed in the printing machine are magnetic brush developer units. A typical magentic brush developer unit employs a magentizable developer mix of carrier granules and toner particles. The developer unit forms a directional flux field to continually create a brush of developer mix. This developer mix is brought into contact with the latent image recorded on photoconductive surface 12. The toner particles adhering electrostatically to the carrier granules of the developer mix are attracted to the latent image thererby rendering it visible. Developer units 30, 32 and 34, respectively, contain discretely colored toner particles. Each of the developer units contain toner particles complimentary in color to the single color light image transmitted through the three different color filters. For example, latent image formed from a green filtered light image is rendered visible by depositing green absorbing magenta toner particles thereon. Similarly, latent images formed from blue and red light images are developer with yellow and cyan toner particles, respectively.

After the latent image recorded on photoconductive surface 12 is developed, drum 10 rotates to transfer station D. At transfer station D, the toner powder adhering electrostatically to photoconductive surface 12 is transferred to a copy sheet or a sheet of support material 36. Transfer roll 39 is electrically biased to a potential of sufficient magnitude and polarity to electrostatically attract toner particles from photoconductive surface 12 thereto. As shown in FIG. 1, transfer roll 38 rotates in the direction of arrow 40, (at substantially the same tangential velocity as drum 10). Thus, successive toner powder images may be transferred from photoconductive surface 12 to sheet 36 secured to roll 38. A suitable electrically biased transfer roll is described in U.S. Pat. No. 3,612,677 issued to Langdon et al. in 1971.

Briefly describing the sheet feeding path, support material 36 is advanced from a stack 42 thereof disposed upon tray 44. Feed roll 46, in operative communication with retard roll 48, separates and advances the uppermost sheet from stack 42. The sheet moves into chute 50 to be directed into the nip between register rolls 52. Register rolls 52 align and forward the sheet, in synchronism with the movement of transfer roll 38. Transfer roll 38 has gripper fingers 54 mounted thereon. Gripper fingers 54 receive the sheet and secure it releasably on roll 38. After the requisite number of toner powder images have been transferred to sheet 36, in superimposed registration with one another, sheet 36 is separated from transfer roll 38. The foregoing is achieved by having gripper fingers 54 space sheet 36 from transfer roll 38 as it rotates in the direction of arrow 40. This permits stripper bar 56 to be interposed therebetween separating sheet 36 from transfer roll 38. Sheet 36 passes over stripper bar 56 onto conveyor 58. Conveyor 58 moves support material 36 into fixing station E.

At fixing station E, a fuser, indicated generally by the reference numeral 60, permanently affixes the transferred toner powder images to support material 36. One type of suitable fuser is described in U.S. Pat. No. 3,826,892 issued to Draugelis et al. in 1974. After the fixing process, sheet 36 is advanced by conveyors 62 and 64 to catch tray 66 for subsequent removal therefrom by the machine operator.

Invariably, after the transfer process, residual toner particles adhere to photoconductive surface 12. Cleaning station F, the final processing station in the direction of rotation of drum 10, as indicated by arrow 14, removes these residual toner particles. A pre-clean corona generating device (not shown) neutralizes the charge on photoconductive surface 12 and that of the residual toner particles. This enables brush 68, in contact with photoconductive surface 12, to remove the residual toner particles therefrom. A suitable brush cleaning system is described in U.S. Pat. No. 3,590,412 issued to Gerbasi in 1971.

It is believed that the foregoing description is sufficient for purposes of the present application to describe the features of the electrophotographic printing machine in which the present invention is incorporated.

Figure 2:
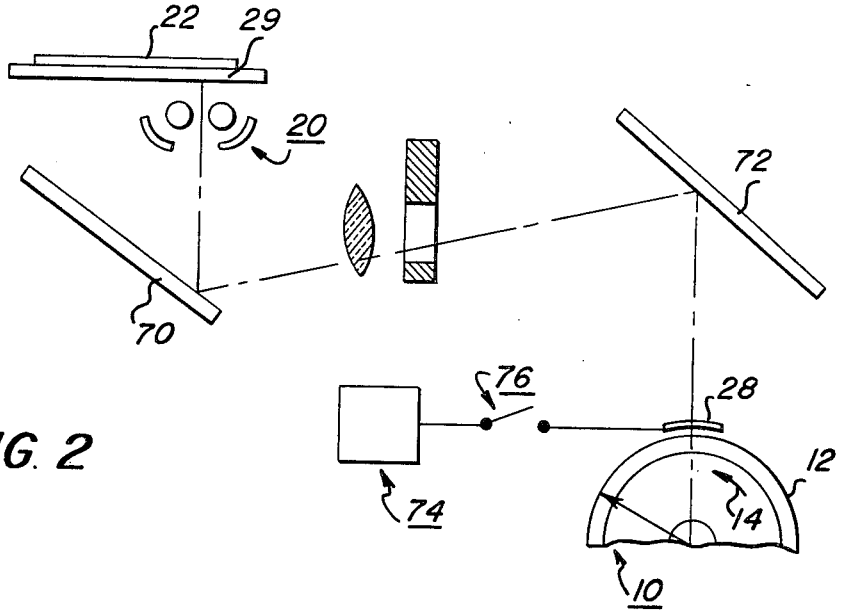
FIG. 2 is an elevational view of the exposure system employed in the FIG. 1 printing machine.

Referring now to FIG. 2, there is shown exposure station B in greater detail. As shown thereat, lamps 26 move across platen 24 with original document 22 disposed thereon facedown. The light rays reflected from original document 22 pass through transparent platen 24 onto mirror 70. Mirror 70 reflects the light rays through lens 18 which forms a flowing light image thereof. The flowing light image is then transmitted through the appropriate filter of filter mechanism 20 to produce a single color flowing light image. This single color flowing light image is reflected by mirror 72 through transparent member 28 onto the charged portion of photoconductive surface 12. Transparent member 28 is deformable and arranged to produce a plurality of substantially equally spaced grooves therein. Deformation of transparent member 28 occurs when power supply or voltage source 74 is electrically coupled thereto as so to apply the requisite voltage level, e.g., a D.C. power supply of several hundred volts. Normally power supply 74 is decoupled from transparent member 28 inasmuch as actuating means or switch 76 is normally open. However, switch 78 is operator actuatable and upon being closed power supply 74 applies the requisite voltage level to transparent member 28 producing grooves therein. Thus, the printing machine is operatable in two modes, i.e., a pictorial copying mode or a functional mode. When the machine is in the functional copying mode, switch 76 is opened decoupling power supply 74 from transparent member 28. Contrawise, when the printing machine is in the pictorial copying mode, switch 76 is closed coupling power supply 74 to transparent member 28. In this latter mode of operation, power supply 74 applies a sufficient voltage to transparent member 28 to produce a deformation pattern therein corresponding to a plurality of substantially equally spaced grooves. The light image passing through the grooved portion of transparent member 28 is phase shifted relative to the light image passing through the non-grooved portion. In this way, the single color light image is modulated. Contrawise, when power supply 74 is decoupled from transparent member 28, transparent member 28 remains un-deformed, i.e., no grooves are formed therein. Thus, the light image passing therethrough is no longer modulated. Hence, depending upon the mode of operation, a modulated or unmodulated light image irradiates the charged portion of photoconductive surface 12 producing the corresponding latent image thereon.

Preferably, transparent member 28 is an arcuate member having a curvature substantially equal to the curvature of drum 10. In addition, the centers of curvature of transparent member 28 and drum 10 are substantially coincident with one another. The radius of curvature of transparent member 28 is greater than the radius of curvature of drum 10, the difference defining the spacing therebetween. The spacing between photoconductive surface 12 and transparent member 28 may be adjusted. This regulates the contrast of the resultant copy in the pictorial mode of operation. Thus, in the pictorial mode of operation, contrast may be adjusted by regulating the spacing between transparent member 28 and photoconductive surface 12. The foregoing may be achieved as part of the machine set-up, or, in operation, if transparent member 28 is adjustable along the radius of curvature thereof. The utilization of a curved screen is previously known and more fully described in copending application Ser. No. 566,886 filed in 1975. Moreover, the technique of adjusting the spacing between the photoconductive surface and screen is known and discussed in other patents.

Figure 3:
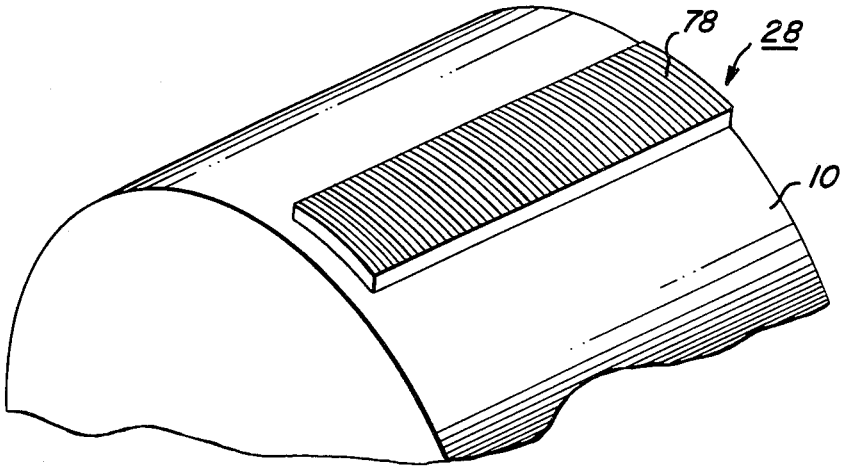
FIG. 3 is a schematic, perspective view depicting the relationship of the screen member and photocoductive member employed in the FIG. 1 printing machine.

Referring now to FIG. 3, there is shown transparent member 28 in association with drum 10. As shown thereat, transparent member 28 is energized and has a plurality of substantially equally spaced grooves 78 therein (shown greatly enlarged thereat for clarity). Grooves 78 are formed only when power supply 74 (FIG. 2) is coupled or electrically connected to transparent member 28 by closing switch 76 (FIG. 2).

It is apparent that, in multi-color electrophotographic printing, the modulated light image should have the same intensity pattern irrespective of the wave length of light transmitted thereto. If the phase screen, i.e., transparent member 28 with grooves 78 therein is wave length dependent, then a different electrostatic intensity pattern will be produced on the photoconductive surface for each single color light image. For example, a blue light is transmitted by the filter during exposure of one cycle then such a phase screen will produce an electrostatic half-tone pattern at twice the screen frequency. Consequently, the electrostatic charge pattern developed for each cycle of the color process will produce different half-tone patterns resulting in a poor quality copy. Thus, it is desirable to employ a phase screen that will provide substantially the same intensity pattern at the same spatial frequency over an extended wave length range, particularly over the visible region. This may be achieved, in a manner previously known for non-deformable phase screens, by deforming transparent member 28 such that the grooves formed therein are to a known prescribed depth, but which is selectively adjustable. Preferably, each groove 78 is $0.25\mu$ deep and transparent member 28 is about 0.1 inches thick. With grooves of this depth, phase screen 28 will provide a relative phase shift of about 90° for light in the center of the visible spectrum. That is, light wave length in the center of the visible spectrum passing only through, for example, the non-grooved portion of transparent member 28 will be phase shifted about 90° with respect to such light which is transmitted through the grooved portion of transparent member 28. Such a phase shift will produce an intensity modulated light pattern which produces an electrostatic half-tone pattern on photoconductive surface 12 of a particular geometry. Moreover, this phase screen will produce an interference pattern on photoconductive surface 12 of substantially the same shape at the same spatial frequency over the visible wave length region of 400 to 700 nanometers. The depth of grooves 78 may range from about $0.23\mu$ to about $0.27\mu$ and still provide a half-tone pattern which is substantially the same for the range of spatial frequency across the visible spectrum. The relative phase shift produced by such a phase screen varies from about 65° to about 115° across the visible spectrum. In alternate embodiments, each groove 78 may be $2.8\mu$ deep, thereby providing relative phase shifts of $13 \times 90°$, $11 \times 90°$, and $9 \times 90°$ (for the colors hereinbefore discussed) of such wave lengths, respectively. These relative phase shifts are all equivalent to 90°. Thus, this particular screen is useful for producing substantially similar half-tone patterns for blue, green and red light. The theoretical basis for the formulation of groove depth and the above dimensions are described in co-pending prior application Ser. No. 556,387 filed in 1975, the disclosure thereof being hereby incorporated into the present application Turning now to FIGS. 4 and 5, the detailed structural configuration of transparent member 28 will hereinafter be described. A fine conductive grid line pattern 80 is formed on one side of a resiliently deformable dielectric layer 82. A second layer 84 of condutive material is formed on the other side of dielectric layer 82. Power supply 74 is coupled to conductive grid 80 via switch 76. Conductive grid 82 are secured to a generally planar substantially rigid transparent insulative substrate 86, such as glass. Conductive layer 84 is electrically grounded. Layer 84 overlies layer 82, both layers being deformable in unison. Thus, closing switch 76 connects power supply 74 to grid 80. This results in a bias voltage gradient forming between conductive grid 80 and conductive deformable layer 84, i.e., across dielectric layer 82 in the area of grid 80. This will cause deformation of layer 84 and dielectric layer 82 in a deformation pattern corresponding directly in position and spacing to the conductive pattern of grid 80 and corresponding in depth to the applied voltage when switch 76 is closed, as known from the "Frost" technique described in previously cited co-pending application Ser. No. 580,654 filed in 1975. Deformable layer 84 and layer 80 are transparent in the present invention. Conductive grid 80 comprises a pattern of substantially parallel, straight lines as shown in FIG. 5. These lines are commonly electrically connected to each other so as to remain always at the same potential, being connectable at a single point to a voltage supply. Conductive grid 80 may, for example, comprise a metal layer applied as a foil, as a vacuum evaporated layer, as a chemically deposited or photo etched layer, or the like. When sufficiently thin, such a metal layer may be transparent. For example, insulative substrate 86 may comprise glass or a similar refractory material with a transparent conductive layer of tin oxide coated thereon by known methods forming grid 80. Deformable layer 82 is an electrically insulating deformable plastic layer which is transparent, typical plastics which may be suitable are disclosed in U.S. Pat. No. 3,436,216 issued in 1969 to Urbach, and other "Frost" systems noted hereinbefore, the relevant portions thereof being hereby incorporated into the present application. Exemplary of these are phenolformaldehyde polymers. However, an elastomeric material such as a urethane is preferred. A material of this type provides automatic resilient removal of the deformations of layer 82 upon relaxation of the stress. This material is preferable to one requiring the application of heat to remove the deformations. It should be noted, that in the event heat is required, it could be readily provided, i.e., by actuation of an auxiliary heater upon de-energization of the screen. Insulative substrate 86 may be any suitable transparent plastic or glass. Thus, screen 28 is transparent to all generally perpendicular light rays.

Alternative embodimets of the hereinbefore discussed embodiment will now be described. While in the embodiment previously discussed variable bias voltage supply 74 has been shown as being connected to grid 80 with conductive layer 84 being grounded, one skilled in the art will appreciate that this may be reversed, i.e., conductive layer 84 may be biased by voltage supply 74 with grid 80 being grounded. Likewise, the structures of the two conductive members can be reversed in position or substituted for one another as alternative embodiments, i.e., either or both of the conductive surfaces 78 and 80 can be made in the appropriately finely spaced pattern. Another possible alternative embodiment would be to eliminate the rigid supporting substrate 86 and support the dielectric layer 82 and its opposing parallel spaced conductive layers 80 and 84 under tension within a rigid frame. In that case, both surfaces of the dielectric layer 82 would deform in the desired pattern, and, of course, conductive layers 80 and 84 would flex therewith.

The operation of the alternative embodiments is substantially the same. In all cases, the voltage potential applied across the elastomeric transparent dielectric produces a mechanical stress in this material resulting in a groove corresponding in depth to the level of voltage applied thereto. This forms the desired deformation pattern phase shifting the light image transmitted through the transparent member. The location of the conductive grid elements controls the location of the deformation. Thus, the desired deformation pattern and the spacing of the deformations is selected and controlled by the manufacture of the conductive grid pattern. The depth of the deformed areas relative to the adjacent un-deformed areas is selective and variable during the actual operation of the printing. This is achieved by simply changing the voltage applied. By varying the voltage applied to the transparent member, the deformations therein may be controlled to compensate for thermal and other material changes inducing shifts from the desired depth. Upon removal of the bias voltage from the conductive grid, the resiliency of the transparent dielectric material layer substantially instantaneously restores it to its normal planar surface configuration.

Unlike a liquid crystal screen, no liquids or coloidal solutions or special manufacturing techniques or materials therefor are required. Optical grinding, scribing, ruling, alignment or other such critical manufacturing operations commonly used in making fixed optical screens or gratings are not required for the phase screen of the present invention.

In recapitulation, it is evident that the electrophotographic printing machine heretofore described operates in one of two modes, i.e., pictorial or functional mode. In the pictorial mode, a transparent member interposed into the optical light path is energized forming grooves therein which phase shift the light image passing therethrough relative to the light image passing through the non-grooved portion. In this way, a modulated light image is transmitted to the charged portion of the photoconductive surface recording a modulated electrostatic latent image thereon. Contrawise, in the functional mode, the electrostatic latent image remains unmodulated. In this mode, the transparent member remains un-energized, i.e., ungrooved, thereby not modulating the light image transmitted therethrough. Thus, the light image irradiating the charged portion of the photoconductive surface remains unmodulated and the resultant latent image recorded thereon is also unmodulated.

It is, therefore, apparent that there has been provided in accordance with the present invention, an electrophotographic printing machine that operates in the pictorial or functional mode. The printing machine fully satisfies the objects, aims and advantages hereinbefore set forth. While the present invention has been described in conjuction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. An apparatus for recording a latent image of an original document on a photosensitive member, including:

a deformable transparent member;

means for projecting a light image of the original document through said transparent member onto the photosensitive member to record the latent image thereon;

means for deforming restorably said transparent member to form a pattern of spaced deformations therein which phase shifts the light image passing therethrough with respect to the light image passing through the non-deformed portions thereof so as to modulate the light image transmitted to the photosensitive member; and means for actuating selectably said deforming means.

2. An apparatus as recited in claim 1, wherein said deforming means forms grooves in said transparent member having a selectably variable depth for enabling substantially the same modulated light image to be produced at the same spatial frequency on the photosensitive member over a range of wave length of light.

3. An apparatus as recited in claim 2, wherein said transparent member includes:

a first layer of resiliently deformable dielectric material;

a second layer of electrically conductive material contiguous with one surface of said first layer, said second layer comprising a plurality of spaced strips; and a third layer of electrically conductive deformable material contiguous with the other surface of said first layer, said second layer and said third layer being responsive to the application of a bias voltage therebetween for forming the grooves in said transparent member.

4. An apparatus as recited in claim 3, wherein said deforming means includes a voltage source coupled to said second layer of said transparent member.

5. An apparatus as recited in claim 4, wherein said actuating means includes switching means coupling said voltage source to said second layer of said transparent member.

6. An apparatus as recited in claim 5, wherein said transparent member is a generally planar member.

7. An apparatus wherein the photosensitive member is an arcuate member, as recited in claim 5, wherein said transparent member is an arcuate member having a curvature substantially equal to the curvature of the arcuate photosensitive member with the centers of curvature being in coincidence with one another and the radius of curvature of said transparent member being greater than the radius of curvature of the photosensitive member.

8. An apparatus as recited in claim 5, wherein the wave length of the light image transmitted through said transparent member ranges from about 400 to 700 nanometers.

9. An apparatus as recited in claim 8, wherein the phase shift ranges from about 65° to about 115°.

10. An apparatus as recited in claim 9, wherein said voltage source applies bias voltage sufficient to produce grooves in said transparent member having a depth ranging from about $0.23\mu$ to about $0.27\mu$.

11. An apparatus as recited in claim 9, wherein said voltage source applies a bias voltage sufficient to produce grooves in said transparent member having a depth of about 2.8μ.

12. An electrophotographic printing machine, including:

a photoconductive member;

means for charging at least a portion of said photoconductive member to a substantially uniform potential;

a deformable transparent member;

means for projecting a light image of an original document through said transparent member onto the charged portion of said photoconductive member for recording a latent image thereon;

means for deforming restorably said transparent member to form a pattern of spaced deformations therein which phase shifts the light image passing therethrough with respect to the light image passing through the non-deformed portion thereof so as to modulate the light image transmitted to said photoconductive member; and means for actuating selectably said deforming means.

13. A printing machine as recited in claim 12, further including:

means for developing the latent image recorded on said photoconductive member with particles;

means for transferring the particles from said photoconductive member to a copy sheet in image configuration; and means for affixing permanently the particles to the copy sheet producing a copy of the original document.

14. A printing machine as recited in claim 13, wherein said deforming means forms grooves in said transparent member having a selectably variable depth for enabling substantially the same modulated light image to be produced at the same spatial frequecy on said photoconductive member over a range of wave length of light.

15. A printing machine as recited in claim 14, wherein said transparent member includes:

a first layer of resiliently deformable dielectric material;

a second layer of electrically conductive material contiguous with one surface of said first layer, said second layer comprising a plurality of spaced strips; and a third layer of electrically conductive deformable material contiguous with the other surface of said first layer, said second layer and said third layer being responsive to the application of a bias voltage therebetween for forming the grooves in said transparent member.

16. A printing machine as recited in claim 15, wherein said deforming means includes a voltage source coupled to said second layer of said transparent member.

17. A printing machine as recited in claim 15, wherein said actuating means includes switching means coupling said voltage source to said second layer of said transparent member.

18. A printing machine as recited in claim 17, wherein said transparent member is a generally planar member.

19. A printing machine as recited in claim 17, wherein:

said photoconductive member is an arcuate member; and said transparent member is an arcuate member having a curvature substantially equal to the curvature of said photoconductive member with the centers of curvature being in coincidence with one another and the radius of curvature of said transparent member being greater than the radius of curvature of said photoconductive member.

20. A printing machine as recited in claim 17, wherein the wave length of the light image transmitted through said transparent member ranges from about 400 to about 700 namometers.

21. A printing machine as recited in claim 20, wherein the phase shift ranges from about 65° to about 115°.

22. A printing machine as recited in claim 21, wherein said voltage source applies a bias voltage sufficient to produce grooves in said transparent member having a depth ranging from about 0.23μ to about 0.27μ.

23. A printing machine as recited in claim 21, wherein said voltage source applies a bias voltage sufficient to produce grooves in said transparent member having a depth of about 2.8μ.

* * * * *